United States Patent [19]

Pearce, Jr. et al.

[11] 4,199,214

[45] Apr. 22, 1980

[54] FUSED ELECTRICAL CONNECTOR

[75] Inventors: Warren Pearce, Jr., Warren; Charles W. Ramsey, Niles, both of Ohio

[73] Assignee: General Motors Corporation, Detroit, Mich.

[21] Appl. No.: 28,255

[22] Filed: Apr. 9, 1979

[51] Int. Cl.[2] ..... H01R 13/68

[52] U.S. Cl. ..... 339/147 P

[58] Field of Search ..... 339/147, 276, 277, 223 R; 337/202, 231, 290, 295

[56] References Cited

U.S. PATENT DOCUMENTS 1,067,702 7/1913 Wiegand ..... 339/223 R

*Primary Examiner*—Joseph H. McGlynn
*Assistant Examiner*—John S. Brown
*Attorney, Agent, or Firm*—F. J. Fodale

[57] ABSTRACT

A fused electrical connector of one-piece construction is attached to an electric cable having a conductor core and an insulation jacket. The connector has a ring-shaped contact portion at one end, a U-shaped frame portion having parallel legs attached to the contact portion and a transverse leg longitudinally spaced therefrom, and a crimp barrel projecting from the transverse leg which attaches the connector to the insulation jacket of the electric cable. The connector further includes a cantilevered fuse tongue integrally attached to the contact portion and projecting into the space defined by the U-shaped frame portion. The fuse tongue has a crimp barrel at its free end attaching the fuse tongue to the conductor core of the electric cable.

2 Claims, 4 Drawing Figures

FUSED ELECTRICAL CONNECTOR

This invention relates generally to electrical connectors and more particularly to fused electrical connectors for connecting electric cables to electric terminals.

U.S. Pat. application Ser. No. 964,194 filed Nov. 28, 1978 and assigned to the assignee of this invention discloses a number of fused electrical connectors for connecting electric cables to post terminals. In each embodiment the fused electrical connector comprises several separate parts.

The object of this invention is to provide a fused electrical connector of one-piece construction.

A feature of the invention is that the fused electrical connector is attachable to an electric cable in a conventional manner.

Another feature of the invention is that the fused electrical connector maintains a mechanical connection between the electric cable and a terminal when the electrical connection is broken by fusing of a connector portion.

Other objects and features of the invention will become apparent to those skilled in the art as the disclosure is made in the following detailed description of a preferred embodiment of the invention as illustrated in the accompanying sheet of drawing in which.

Figure 1:
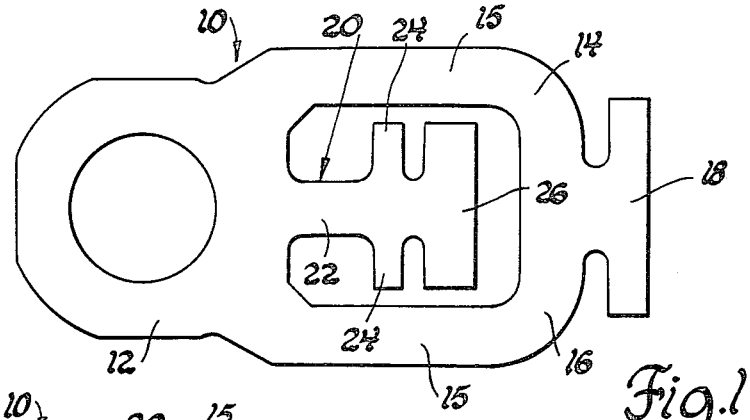
FIG. 1 is a plan view of a stamped blank for making a fused electrical connector in accordance with this invention.
Figure 2:
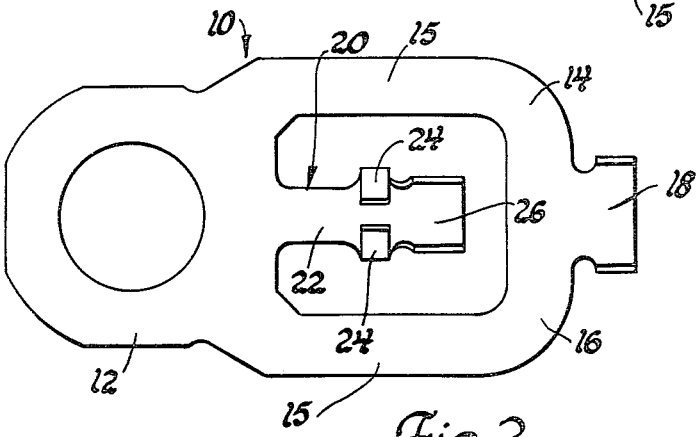
FIG. 2 is a plan view of a fused electrical connector in accordance with this invention.
Figure 3:
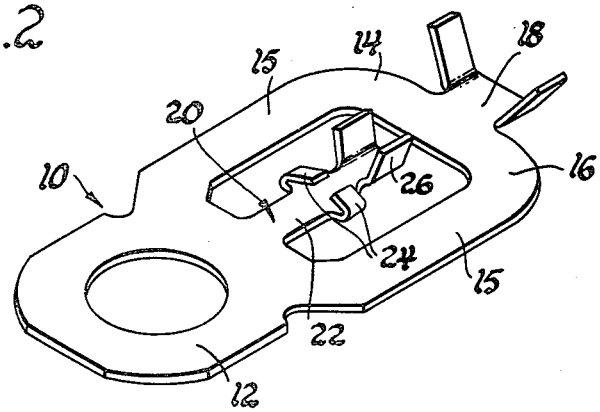
FIG. 3 is a perspective view of the fused electrical connector shown in FIG. 2.

FIGS. 2 and 3 show a fused electrical connector 10 of one-piece construction which is made from the flat stamped sheet metal blank 11 shown in FIG. 1.

The fused electrical connector 10 comprises a ring-shaped contact portion 12 at one end for connection to a post terminal (not shown) and a trailing U-shaped frame portion 14. The U-shaped frame portion 14 is flat and coplanar with the ring-shaped contact portion 12. The transverse leg 16 of the frame portion has a rearwardly projecting open crimp barrel 18 for attaching the connector 10 to the insulation jacket of an electric cable.

The fused electrical connector 10 further comprises an integral cantilevered fuse tongue 20 which projects rearwardly from the ring-shaped contact portion 12 into the open space defined by the frame portion 14. The fuse tongue 20 is between and spaced from each of the parallel legs 15 of the frame portion 14 and terminates short of the transverse leg 16. The fuse tongue 20 has a forward fuse portion 22, a pair of medial stop tabs 24 and an open crimp barrel 26 at its free end for attachment to the conductive core of an electric cable. The center of the ring-shaped contact portion 12, the open conductor core crimp barrel 26 and the open insulation crimp barrel 18 are longitudinally aligned.

Figure 4:
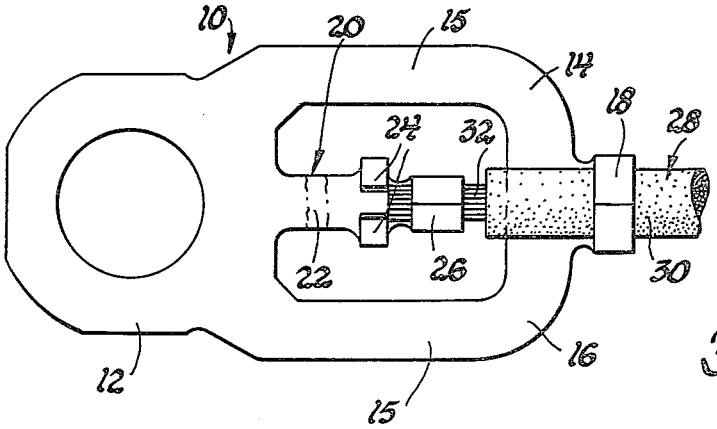
FIG. 4 is a plan view of the fused electrical connector attached to an insulated electric cable.

The fused electrical connector 10 is attached to an electric cable 28 in a more or less conventional manner as shown in FIG. 4, that is by closing or crimping the open crimp barrels 18 and 26 around the insulation jacket 30 and insulation stripped conductor core end 32 of the cable. The medial stop tabs 24 prevent the conductor core end 32 from engaging the fuse portion 22.

The cross section of the fuse portion 22 is specifically chosen and defines the current capacity of the fused electrical connector 10. When the current capacity is exceeded the fuse portion 22 fuses breaking the electrical connection between the conductor core end 32 and the contact and frame portions of the connector. The connector 10, however, remains mechanically connected to the cable 28 by the closed crimp barrel 18. In some instances it may be desirable to enclose the frame and fuse tongue portions 14 and 20 in an insulation sleeve. It is also contemplated that the ring-shaped contact portion 12 can take other shapes such as that of a blade contact.

We wish it to be understood that we do not desire to be limited to the exact details of construction shown and described, for obvious modifications will occur to a person skilled in the art.

Other embodiments of the invention in which an exclusive property or privilege is claimed are defined as follows:

1. A fused electrical connector for attachment to an end of an electric cable having a conductor core and an insulation jacket, comprising:

a one-piece sheet metal member having a contact portion at one end shaped for connection to a terminal, a frame portion attached to the contact portion and an attachment portion at an opposite end for attaching the fused electrical connector to the insulation jacket of an electric cable, said member further including a cantilevered fuse tongue integrally attached to the contact portion and having an attachment portion at its free end for attaching the fuse tongue to the conductor core, said fuse tongue being spaced from the frame portion and determining the electric current capacity of the fused connector, and said frame portion maintaining mechanical attachment of the fused connector to the insulation jacket of the cable upon failure of the fuse tongue due to an excessive electric current.

2. A fused electrical connector for attachment to an end of an electric cable having a conductor core and an insulation jacket, comprising:

a one-piece sheet metal member having a contact portion at one end shaped for connection to a terminal, a U-shaped frame portion having parallel legs attached to the contact portion, a transverse leg longitudinally spaced therefrom, and an attachment barrel projecting from the transverse leg for attaching the fused electrical connector to the insulation jacket of an electric cable, said member further including a cantilevered fuse tongue integrally attached to the contact portion and projecting into the space defined by the U-shaped frame portion, said fuse tongue having a medial stop and an attachment barrel at its free end for attaching the fuse tongue to the conductor core, said fuse tongue being spaced from the frame portion and determining the electric current capacity of the fused connector, and said frame portion maintaining mechanical attachment of the fused connector to the insulation jacket of the cable upon failure of the fuse tongue due to an excessive electric current.

* * * * *